US012274404B2

(12) United States Patent
Gelmi

(10) Patent No.: US 12,274,404 B2
(45) Date of Patent: Apr. 15, 2025

(54) WINDOW CLEANING SYSTEM ESPECIALLY FOR HIGH-RISE BUILDINGS

(71) Applicant: Jean Pierre Gelmi, East Syracuse, NY (US)

(72) Inventor: Jean Pierre Gelmi, East Syracuse, NY (US)

( * ) Notice: Subject to any disclaimer, the term of this patent is extended or adjusted under 35 U.S.C. 154(b) by 395 days.

(21) Appl. No.: 17/699,091

(22) Filed: Mar. 19, 2022

(65) Prior Publication Data

US 2022/0313035 A1 Oct. 6, 2022

Related U.S. Application Data

(60) Provisional application No. 63/163,145, filed on Mar. 19, 2021.

(51) Int. Cl.
*A47L 1/02* (2006.01)

(52) U.S. Cl.
CPC ..... *A47L 1/02* (2013.01)

(58) Field of Classification Search
CPC ..... A47L 1/02
USPC ..... 15/103
See application file for complete search history.

(56) References Cited

U.S. PATENT DOCUMENTS

| | | | | |
|---|---|---|---|---|
| 3,454,976 | A * | 7/1969 | Kijinski | A47L 1/02 15/250.19 |
| 5,353,466 | A * | 10/1994 | Smith | B60S 1/20 359/876 |
| 7,204,344 | B2 | 4/2007 | Korchagin et al. | |
| 8,707,621 | B2 | 4/2014 | Curtis et al. | |
| 2008/0047082 | A1* | 2/2008 | Hong | A47L 1/02 15/103 |
| 2011/0162297 | A1* | 7/2011 | Roelofsen | A47L 1/02 52/204.5 |

FOREIGN PATENT DOCUMENTS

| | | | | |
|---|---|---|---|---|
| WO | WO-0101840 | A1 * | 1/2001 | A47L 1/02 |

* cited by examiner

*Primary Examiner* — Eric J Rosen
*Assistant Examiner* — Aaron R McConnell
(74) *Attorney, Agent, or Firm* — Bernhard P. Molldrem, Jr.

(57) ABSTRACT

A window with incorporated window cleaning features has a deployable window cleaning robotic arm normally disposed within a compartment at one side of the window frame, and which is normally concealed behind doors. The robotic arm can be deployed by opening the doors, and allowing the arm to move across the window pane, spraying water or cleaning fluid onto the window, and then wiping the window with a rubber blade on the robotic arm. Waste water drains out via a channel in the lower frame member, and returns to a water reservoir in the compartment, where the water is filtered and can be reused.

12 Claims, 14 Drawing Sheets

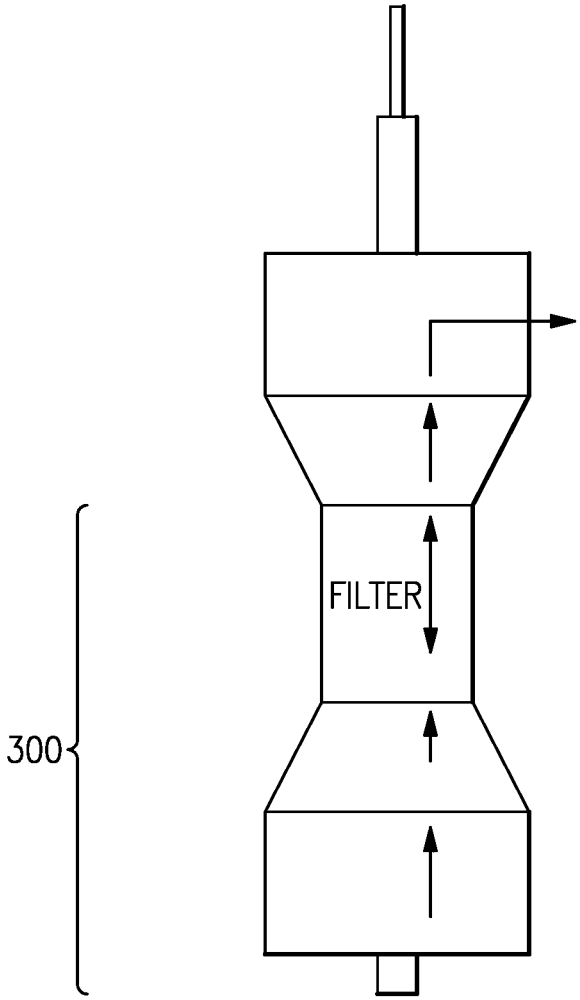
FIG.23
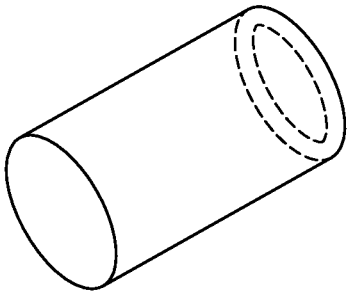

WINDOW CLEANING SYSTEM ESPECIALLY FOR HIGH-RISE BUILDINGS

Applicant claims the benefit under 35 U.S.C. 119(e) of the filing date of his Provisional U.S. Pat. Appln. Ser. No. 63/163,145, Mar. 19, 2021, the contents and disclosure whereof are incorporated by reference herein.

This invention is directed to an automated and/or mechanized and/or robotic system for cleaning of building windows which avoids the need for scaffolding or for devices to suspend workers while cleaning the building's windows. The invention also concerns a window cleaning system that is self-contained in the frame of the window, and which can pop out, project a robotic cleaning arm that traverses the window glass, sprays cleaning water onto the glass, wipes the cleaning water off the glass, and recovers the waste water, to filter and reuse the water for cleaning the window. Before and after a window cleaning operation, the device including the robotic arm and the reservoir for the cleaning water are contained within a pocket or recess in one side of the frame of the window.

It is an object to provide a system that can effect a window cleaning operation on demand, without outdoor human participation, and in particular does not put window cleaning personnel at risk of life or limb while cleaning the window high above the ground.

Working at elevation is a dangerous occupation, and is affected by falls from significant heights every year resulting in worker injury and in some cases death. Because of this risk, any window cleaning operation is expensive in part due to the extensive safety equipment required and in part because of the very high insurance premiums. Accordingly, it is an important object of my invention to provide a system that avoids having anyone on the window cleaning crew being suspended in a scaffold or other mechanism from which the worker may fall.

Thus, my invention involves a robotic arm that is normally hidden behind the frame of the window in a pocket or recess in the building wall, but which emerges from the frame for a window cleaning operation. The robotic arm traverses the window glass, either horizontally or vertically, and sprays cleaning water onto the glass, and at the same time presses a wiper blade against the window glass to squeeze the water and any dirt away. The waste water is caught in a channel or recess along the lower part of the window frame, and this water is filtered and returned to a clean water reservoir that is a portion of the system. Make-up water can be added as needed. After the cleaning operation, the robotic arm including the water spray jet(s) and wiper blade returns to the pocket or compartment in the window frame. The robotic arm can be configured to move vertically or configured to move horizontally when cleaning the associated window.

This invention permits the building operator to wash any or some or all the building's windows, depending on demand. For example, a large window for a restaurant that present a view of the city scape, the window can be cleaned daily, or more frequently as needed, while other office windows may be cleaned on a weekly or monthly basis.

Examples of embodiments of my invention are shown in the accompanying annotated drawing figures. Notes and annotations written on the drawing pages are a part of my disclosure.

DESCRIPTION OF THE DRAWING

FIG. 16 is a more detailed schematic view thereof.

FIGS. 22 and 23 show examples of water filtration arrangements for cleaning and reusing the recycled rinse water captured in the lower channel.

DETAILED DESCRIPTION OF PREFERRED EMBODIMENT(S)

Figure 1:
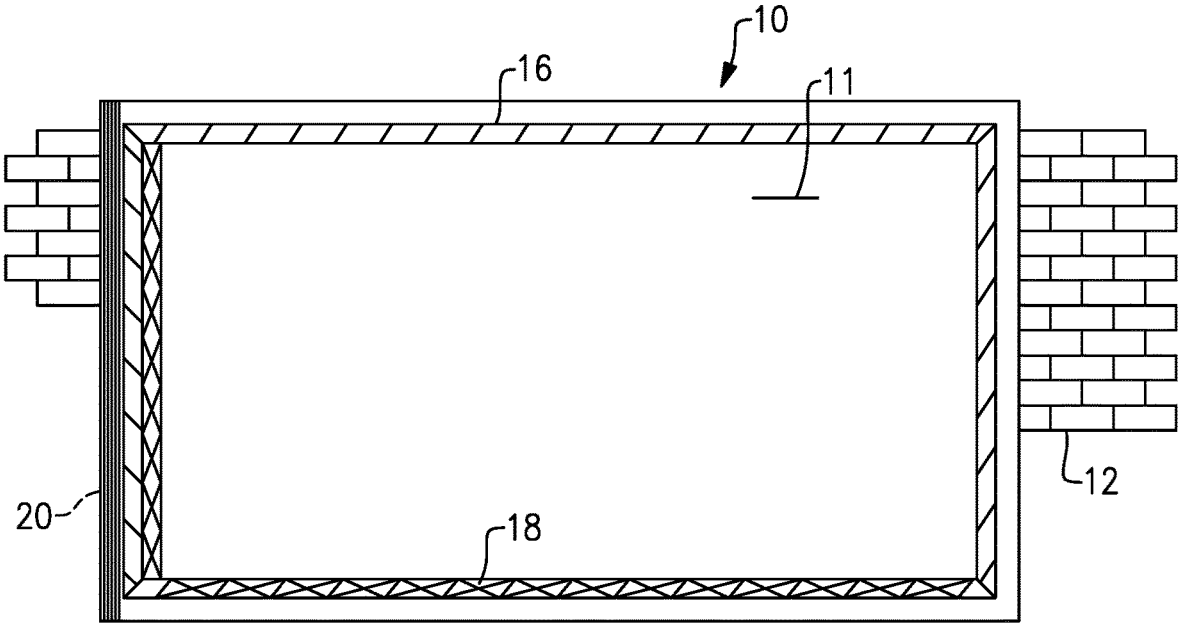
FIG. 1 is an elevation of a window with robotic concealed wash arm according to an embodiment of the invention.

FIG. 1 shows a large window 10 installed in a wall 12 of a high-rise building e.g. an office building of many stories, so that the usual window cleaning procedures present a significant safety risk. A large glass pane 11 is held in a window frame 13 surrounding the glass and fitting into the window opening, here formed in a brick wall. The left part of the frame conceals a robotic wash arm to be discussed shortly, and upper and lower rails 16, 18 of the frame have channels or tracks that are concealed (normally) with rubber covers.

Figure 2:
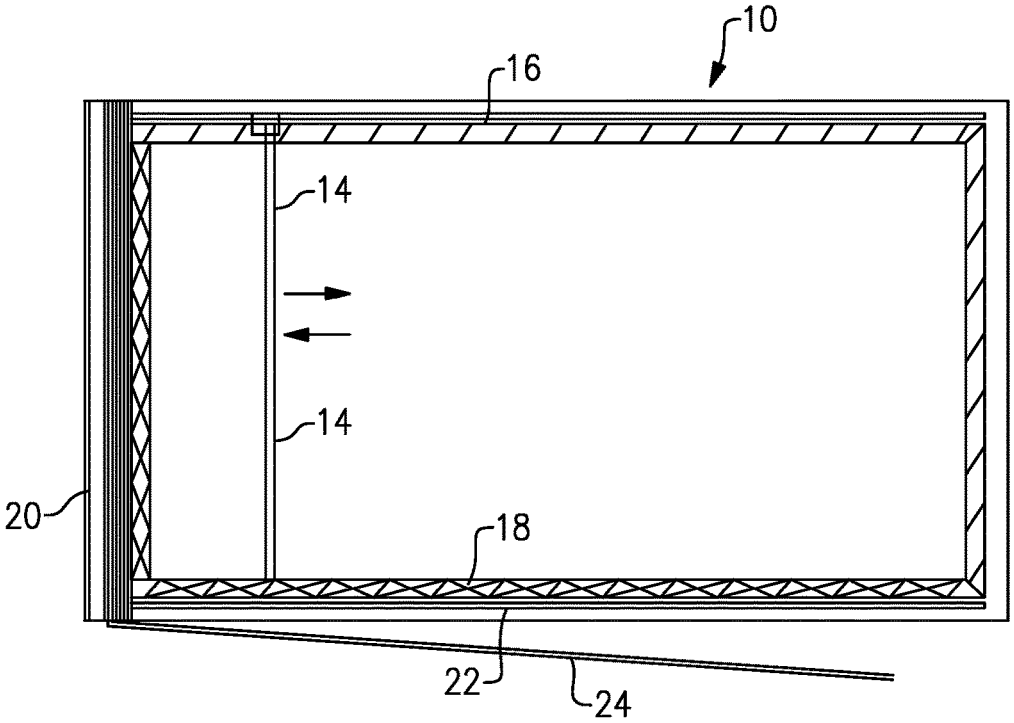
FIG. 2 is another elevation thereof showing the robotic wash arm in action in a window cleaning operation.

FIG. 2 shows the window with the robotic wash arm 14, which comes out from a receptacle or pocket 20 at the left portion of the window frame. The arm 14 travels via upper and lower horizontal channels, Left to Right, and then returns, Right to Left, to the receptacle. During its travel, the robotic arm sprays the window with water (which may contain one or more cleaning additives) and at the same time the vertical wiper blade is contacting the window glass and squeezes the water plus any entrained dirt and grease, which falls down to the channel 22 in the lower rail 16 of the frame. This channel may be a groove or semi-tube, and a waste water tube 24 at one end receives the waste water and directs it to the wash water reservoir (which is concealed behind the left portion of the window frame).

Figure 3:
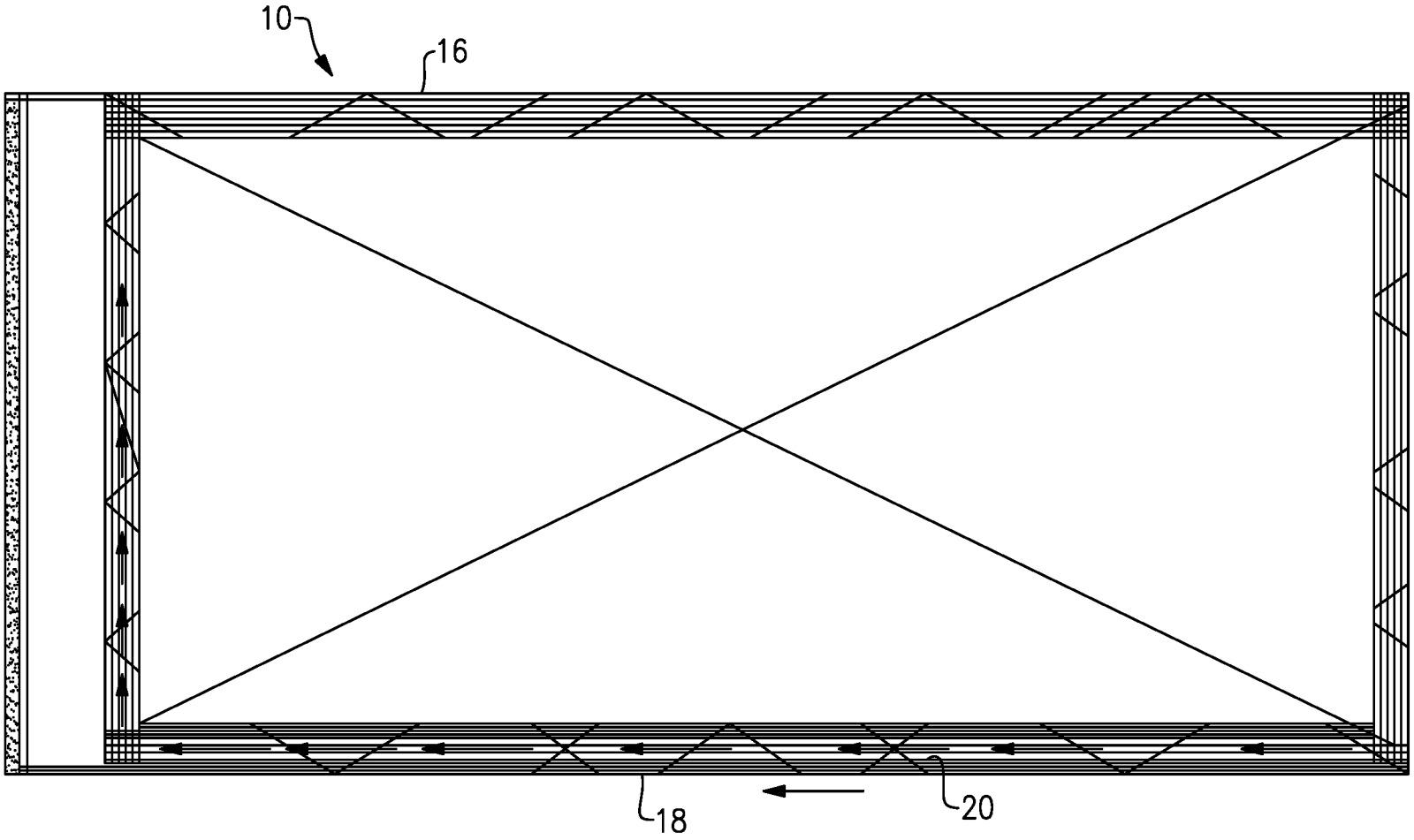
FIG. 3 is an enlargement of the window of this embodiment, showing return of wash water via a lower channel and back to a reservoir.

FIG. 3 is an enlargement of the window, where arrows indicate return of wash water via the lower channel and back to the reservoir.

Figure 4:
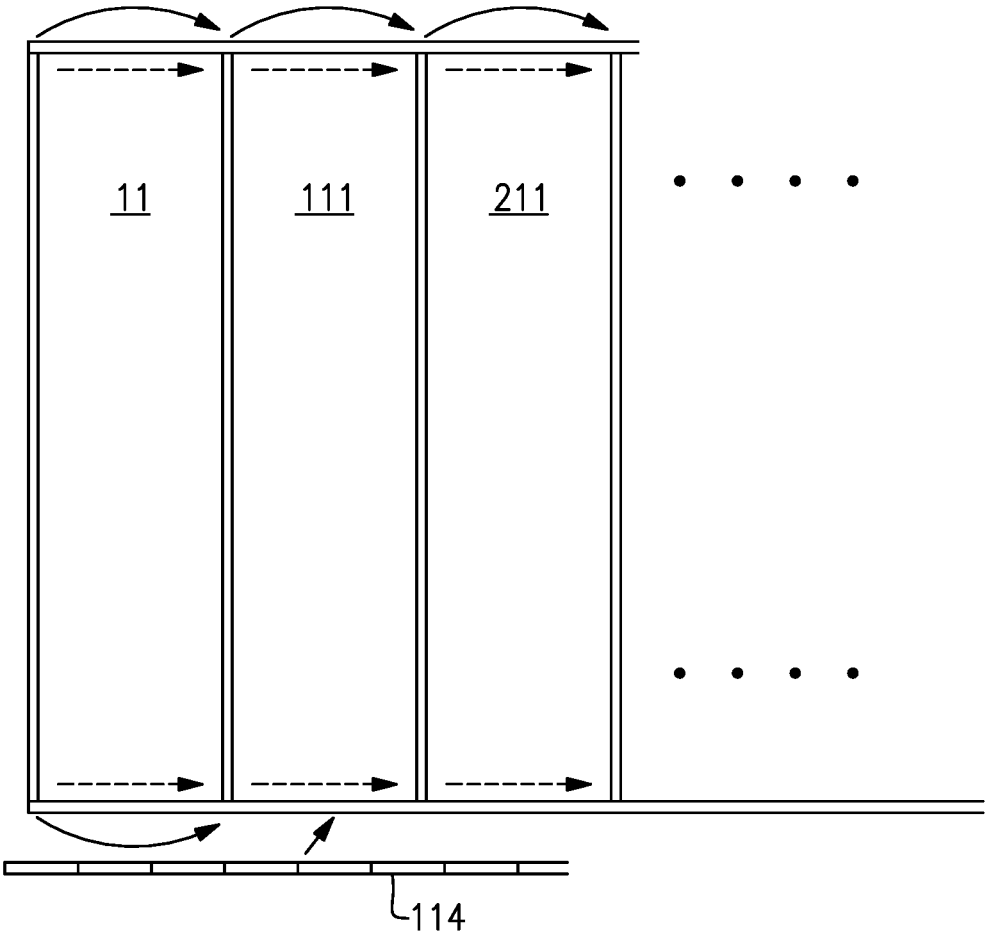
FIG. 4 shows a multiple-pane window embodiment.

FIG. 4 shows a multiple-pane window where the several different window glasses or panes 11, 111, 211 can be washed clean using a single robotic arm 114 washer contained in one of the sides of the window frame.

Figure 5:
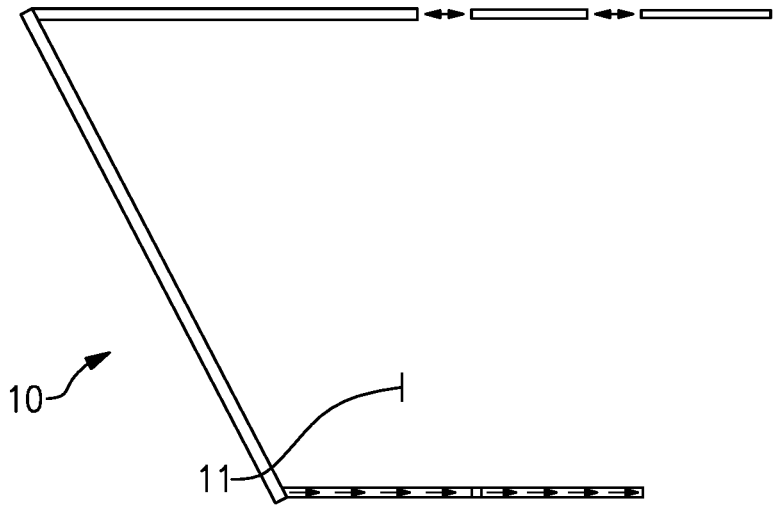
FIG. 5 is a perspective view of a portion thereof.

FIG. 5 is a perspective view of a portion of the window 10. There can be a screw drive in one or both of the upper and lower channels to push the robotic arm 14 transversely across the window glass, and then to bring the robotic arm back to the side of the frame and into the receptacle or pocket 20.

Figure 6:
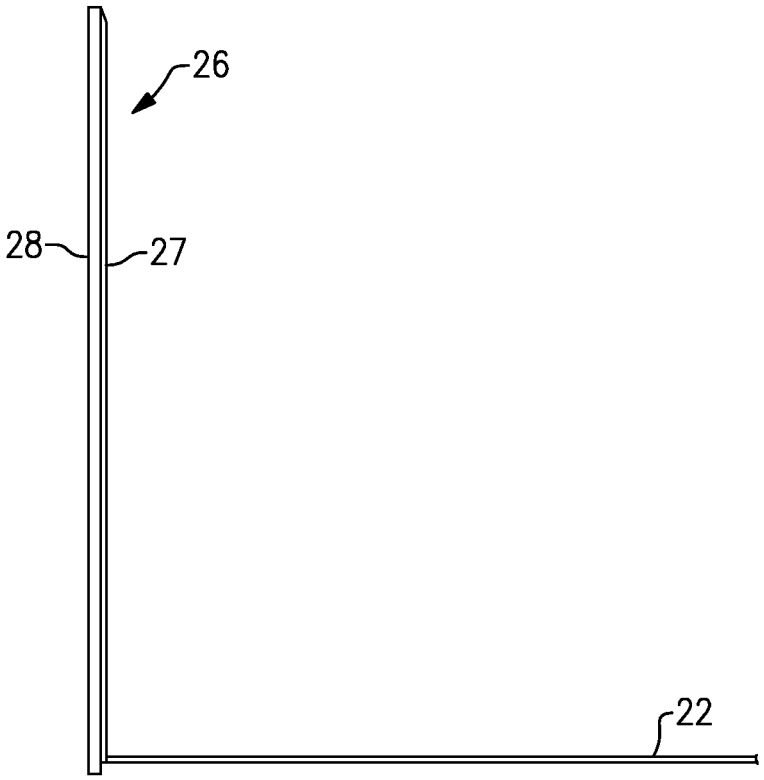
FIG. 6 illustrates a favorable two-part wiper blade of this embodiment.

FIG. 6 indicates that the device may favorably employ a two-part wiper blade, with a sponge rubber along one side which may help wet the window glass, and a hard rubber portion to press onto the glass and squeeze away any waste water toward the lower channel.

Figure 7:
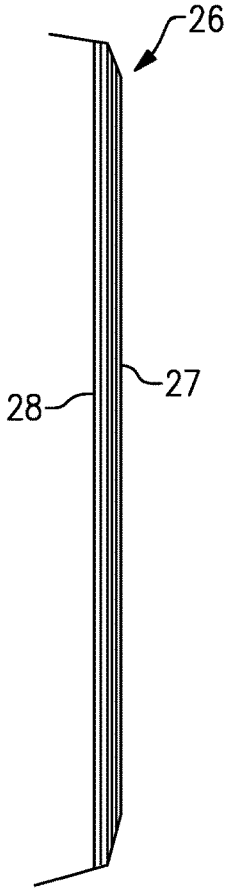
FIG. 7 illustrates detail thereof.

FIG. 7 illustrates more detail of the wiper blade 26, including a sponge rubber portion 27 and hard rubber portion 28.

Figure 8:
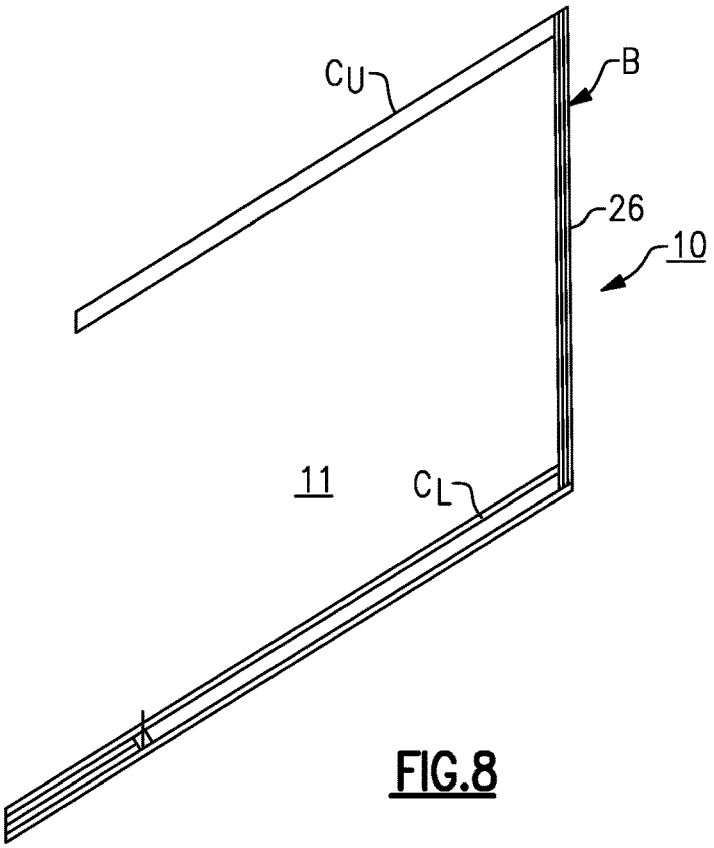
FIG. 8 illustrates a water jet that is carried on the robotic arm.

FIG. 8 demonstrates clean water W spraying onto the window glass pane 11 from a water jet that is carried on the robotic arm 14. The wiper blade 26 squeezes away the water, which then descends to the lower channel 22, and the water goes from there to the waste water drain from which it is returned to the water reservoir. Here it appears the blade 26 (i.e., B) is starting its return sweep from right to left.

Figure 9:
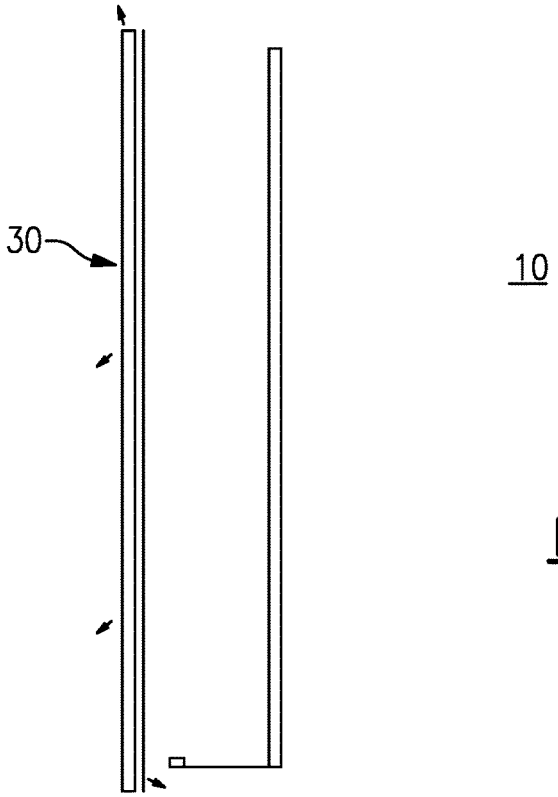
FIG. 9 illustrates vertical doors at the left part of the window frame.

FIG. 9 shows vertical doors 30 (that cover the receptacle or pocket 20) at the left part of the window frame and which open to commence a window washing operation. These normally conceal the robotic arm 14, and open at the beginning of a wash cycle and close at the end when the robotic arm returns.

Here a small motor plus a threaded rod (not shown) can be used to move the robotic arm horizontally.

Figure 10:
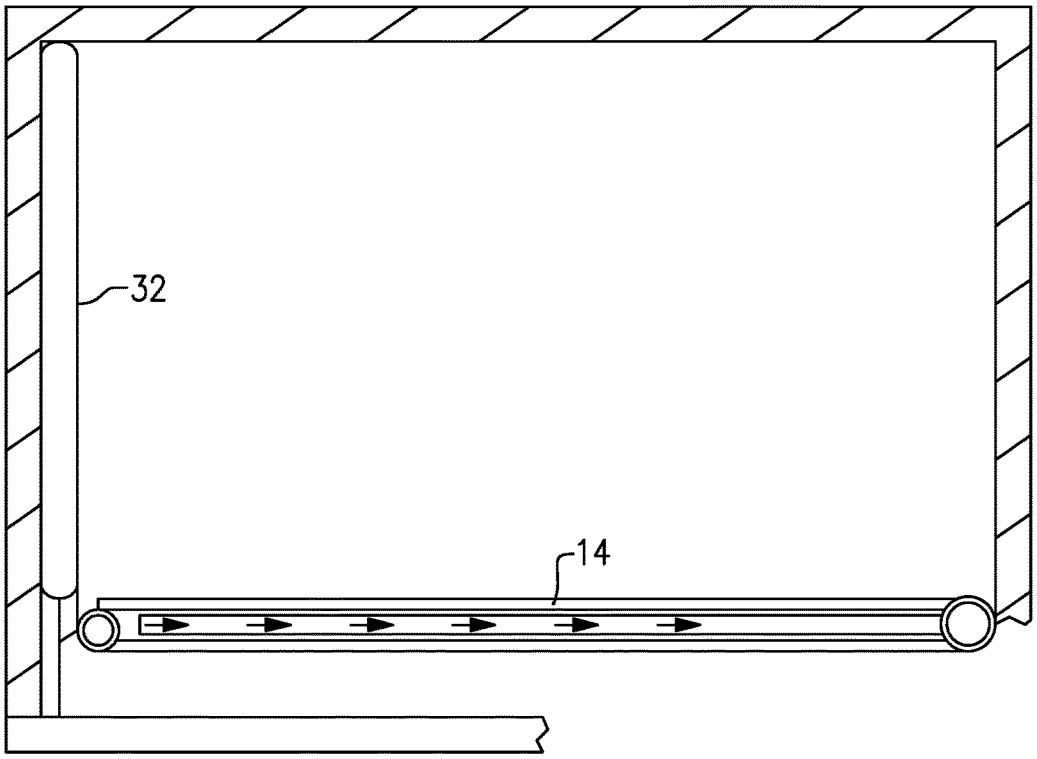
FIG. 10 illustrates a water reservoir at the left part of the frame.

FIG. 10 show the reservoir 32 at the left part of the frame. The blade arm 14 here is in the lower frame, with a robot arm, spray jet, wiper blade that move vertically to the top and then back to the bottom.

Figure 11:
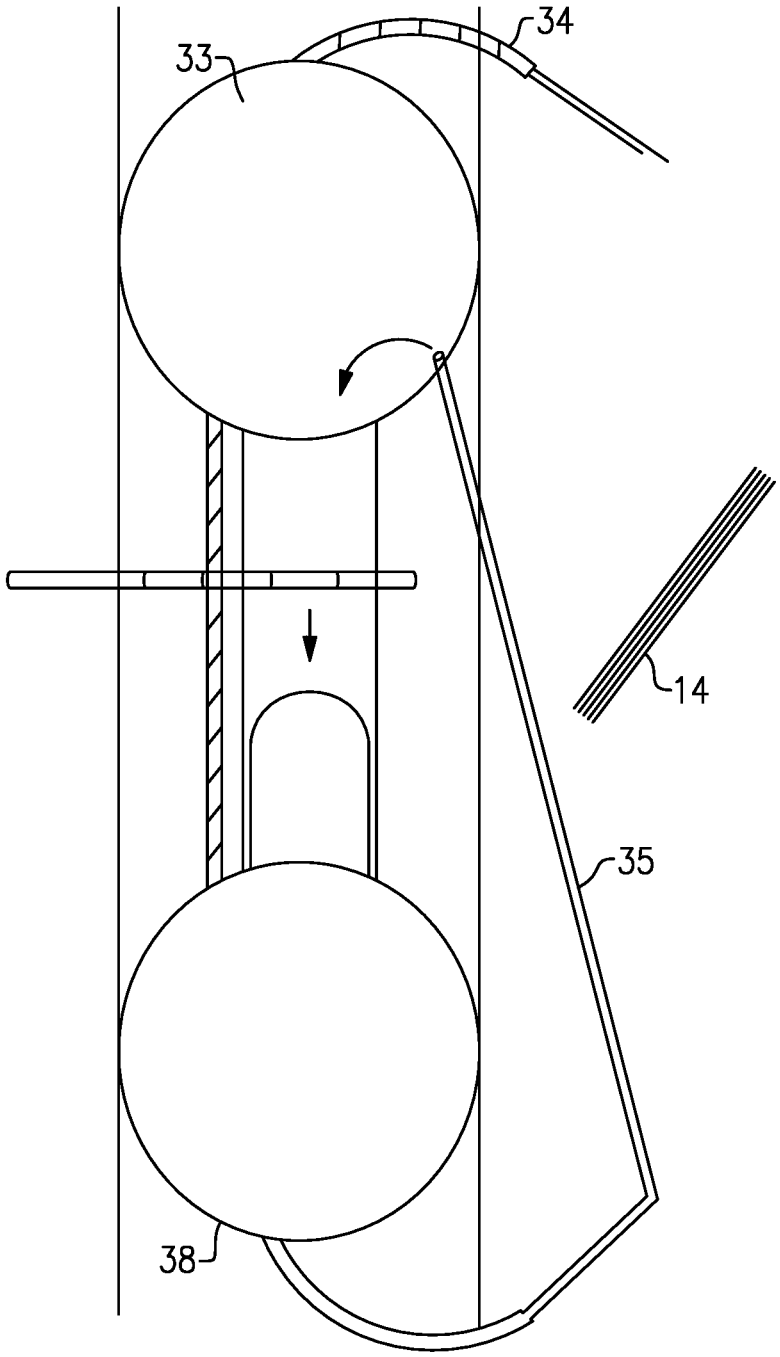
FIG. 11 is a schematic for demonstrating the Wash/Rinse system of this invention.

FIG. 11 is a schematic demonstrating the Wash/Rinse system. A top water canister contains a supply of clean water and may add make-up water as needed. A lower canister contains water and has a filter for removing dirt particles from the water. The dirt particles may be separated centrifugally. A conduit 35 connects to the drain to the return water and supplies return water to both canisters 33 and 38.

Here, water exits the top canister 33 to supply the robotic arm.

Figure 12:
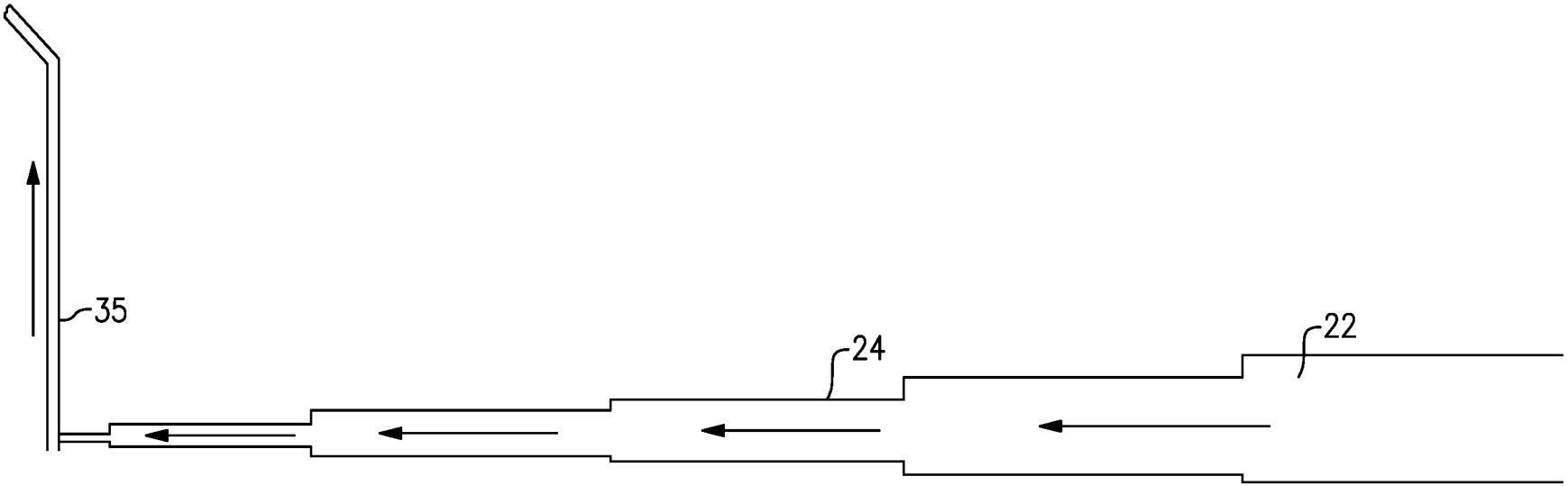
FIG. 12 is a schematic of the flow of supply and return water.

FIG. 12 is a schematic of the flow of water (e.g., from the upper canister 33) to the supply line 34 to the robotic arm 14, and to return water from the waste channel 22 to a return port 36 on the lower water canister 38.

Figure 13:
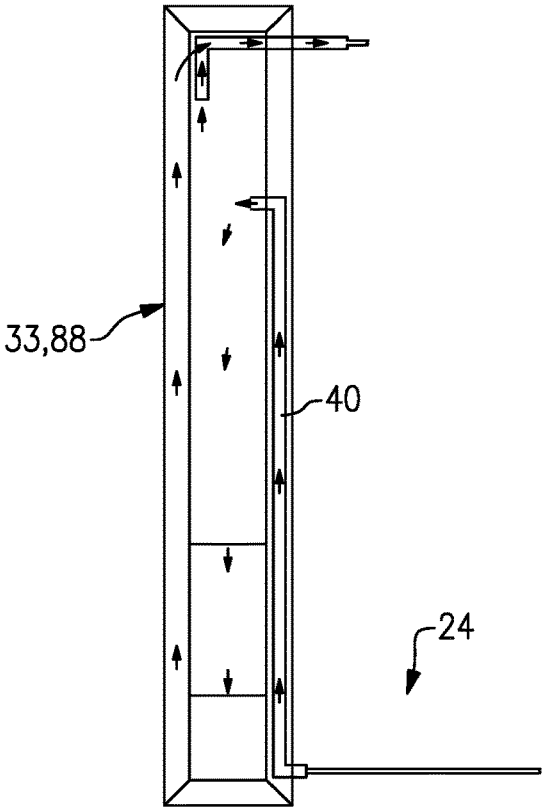
FIG. 13 is a diagram to illustrate the waste water return system/

FIG. 13 illustrates the waste water return from the lower channel with a vertical pumped flow 40 inside the left frame to the canister(s), where the water is filtered and cleaned.

Figure 14:
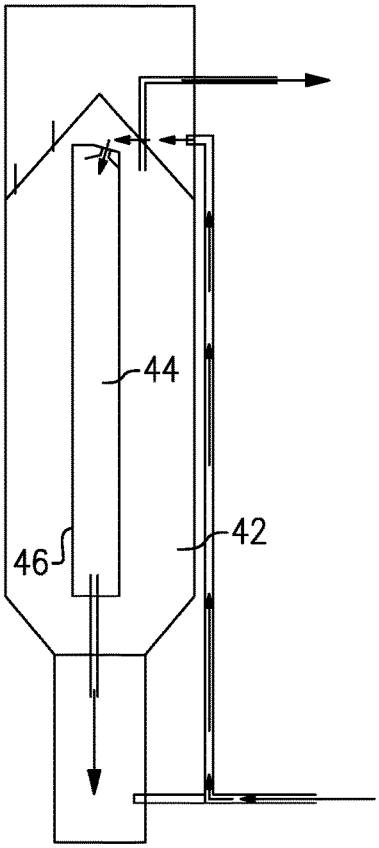
FIG. 14 is a schematic illustrating another possible arrangement of the wash water system.

FIG. 14 shows another possible arrangement of the wash water system 19 that is found in the compartment or pocket 20 within the left window frame. A clean water tank 42 has within it a tubular vertical filter 44; and a cleaning mechanism 46. The return water travels via a return pipe, as illustrated, into the filtering system and cleaning mechanism.

Figure 15:
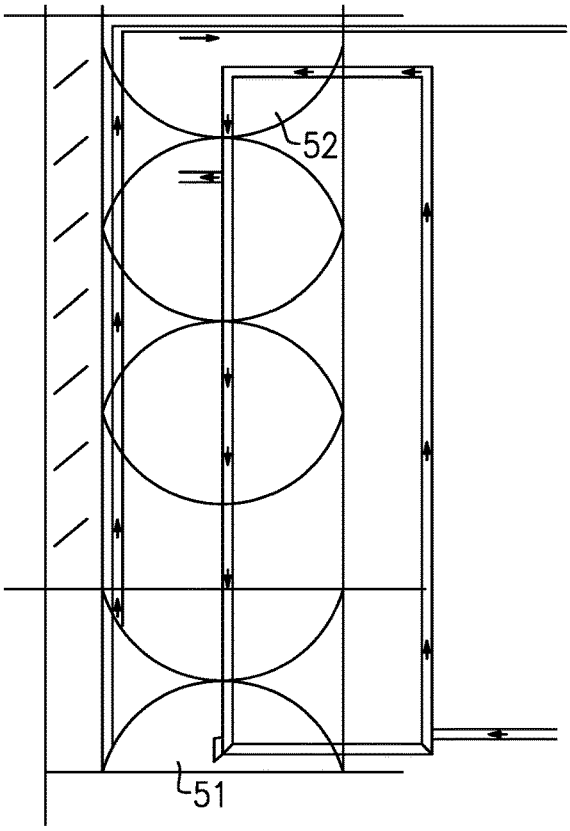
FIGS. 15 and 16 are schematic views showing flow of return water.

FIG. 15 is another schematic showing flow of return water into a system of water canisters 51 to a clean water canister 52. Clean water then flows up and out to the robotic arm (not shown here).

Figure 16:
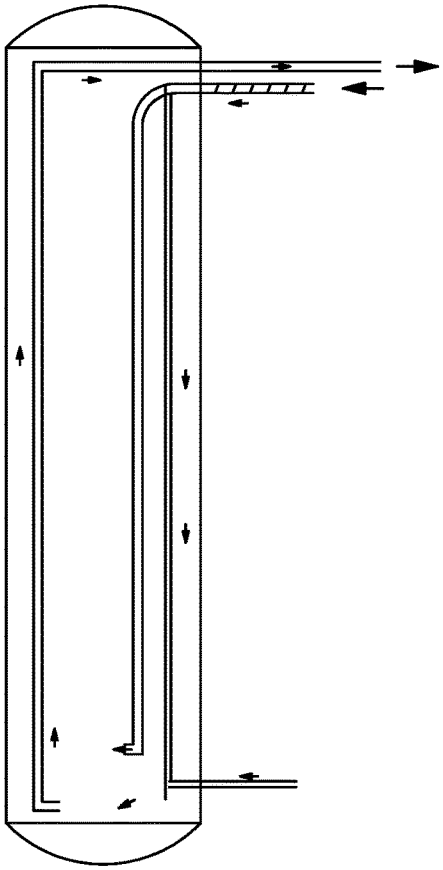

FIG. 16 is a more detailed view of the wash water filtration system.

Figure 17:
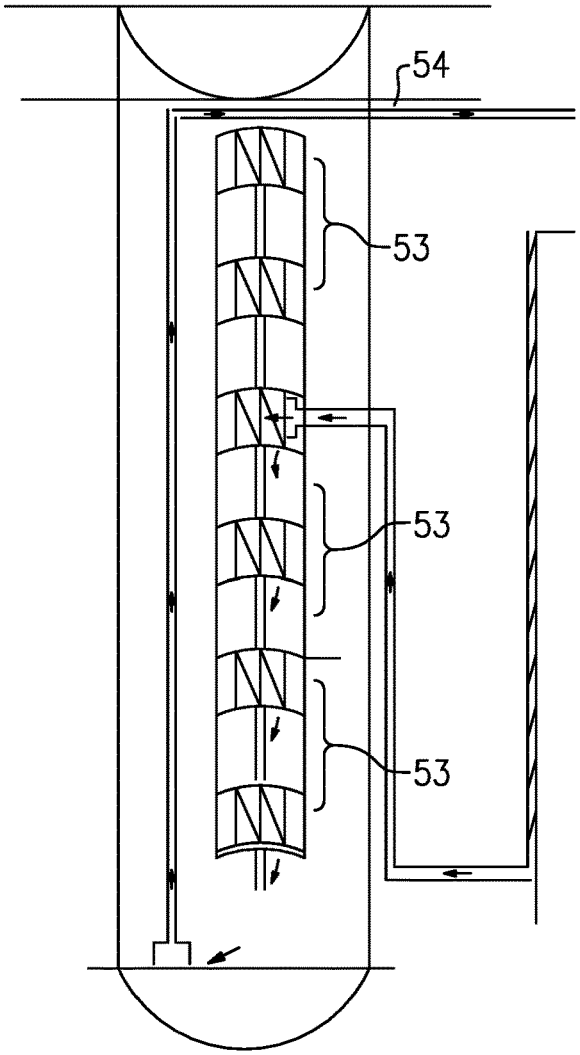
FIG. 17 illustrates an alternative reservoir arrangement of this invention.

FIG. 17 shows another reservoir arrangement, here with a stack of wash-water filters 53 receiving the return water, and with a clean water feed 54 leaving from the water canister and flowing to the robotic arm.

Figure 18:
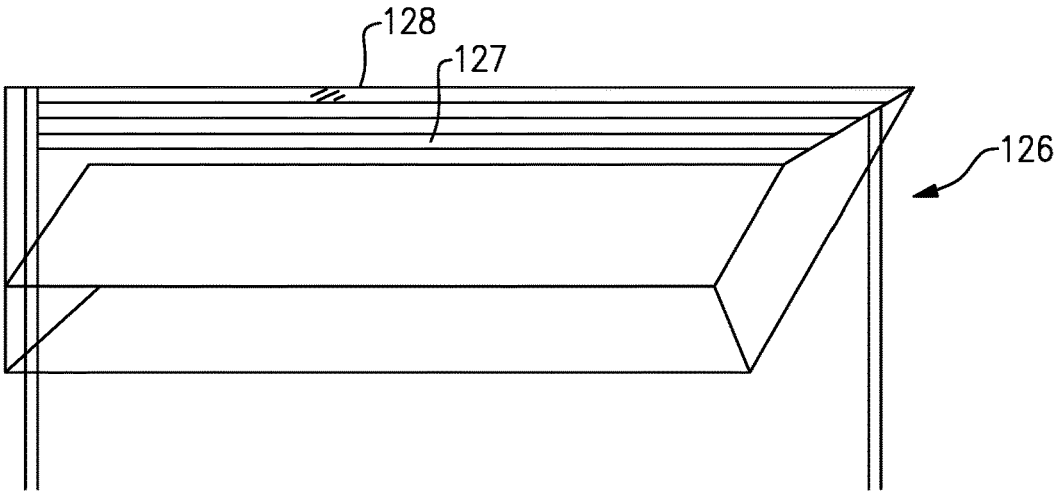
FIG. 18 is a view showing detail of one possible wiper blade used in this invention.

FIG. 18 shows detail of an embodiment of the wiper blade 114 formed partly of foam rubber, 126 and partly hard rubber 127, here side by side, that is solid hard rubber on one side, with foam or sponge rubber on the other side.

Figure 19:
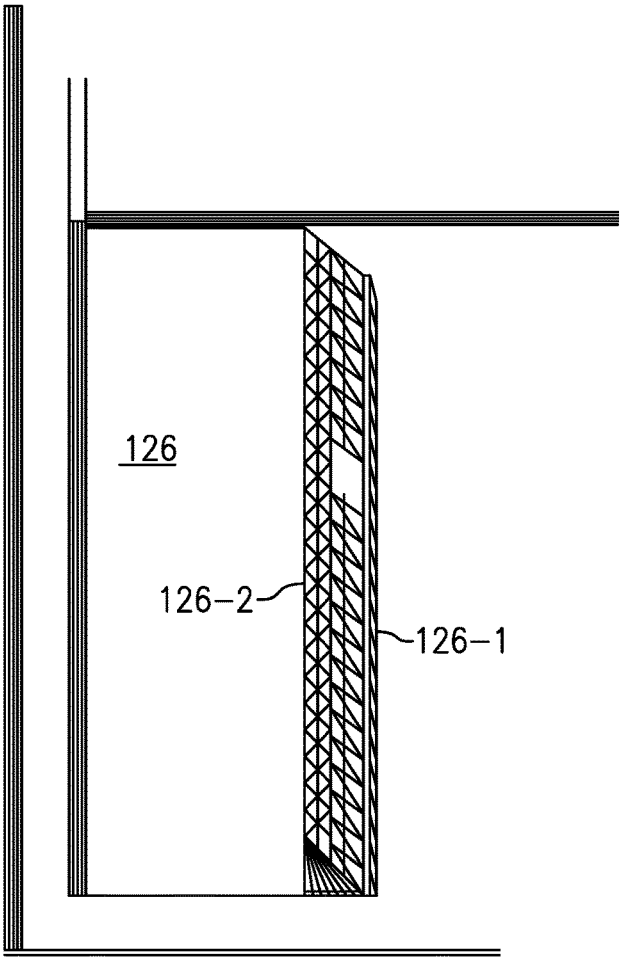
FIG. 19 illustrates detail of a wiper blade used on the robotic arm.

FIG. 19 shows more detail of the wiper blade on the robotic arm, as used when cleaning the window glass.

Figure 20:
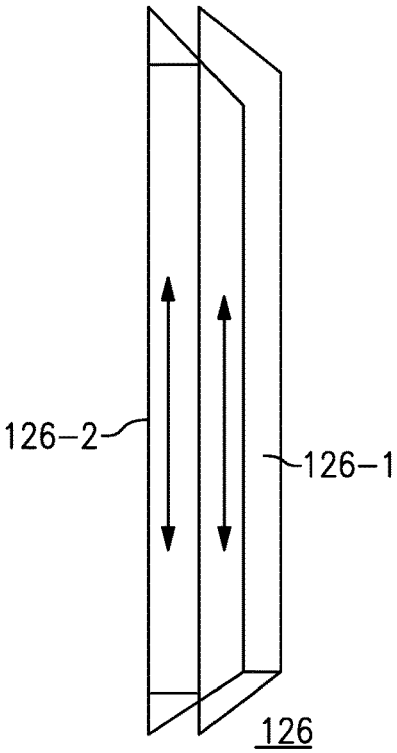
FIG. 20 shows detail of an outer blade side and an inner blade side.

FIG. 20 shows the blade 126 formed of an outer blade side 126-1 and an inner blade side 126-2, which arrangement helps in closing any gaps between the blade and the window and pushing on the outer blade 126-1.

Figure 21:
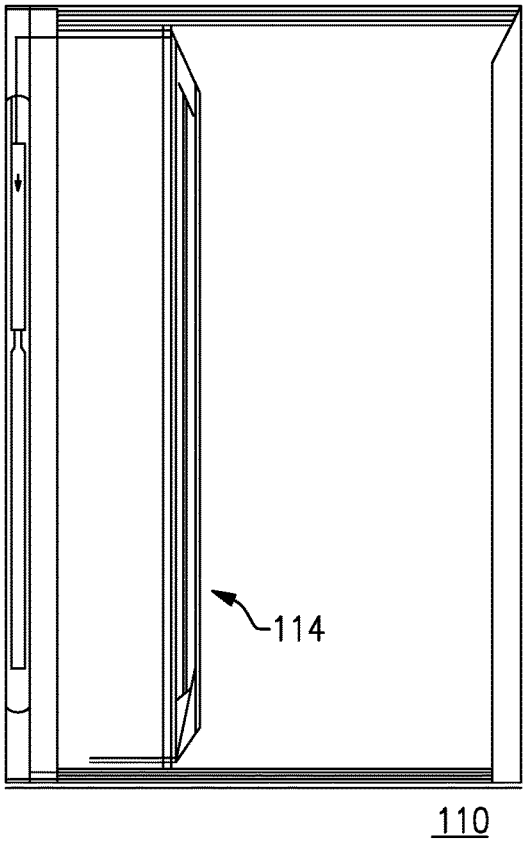
FIG. 21 is a schematic illlustrating the automated robotic-arm window cleaner in use

FIG. 21 shows the automated robotic arm window cleaner in use with a vertically elongated window 110. Here, motion of the wiper blade 114 is from left to right.

Figure 22:
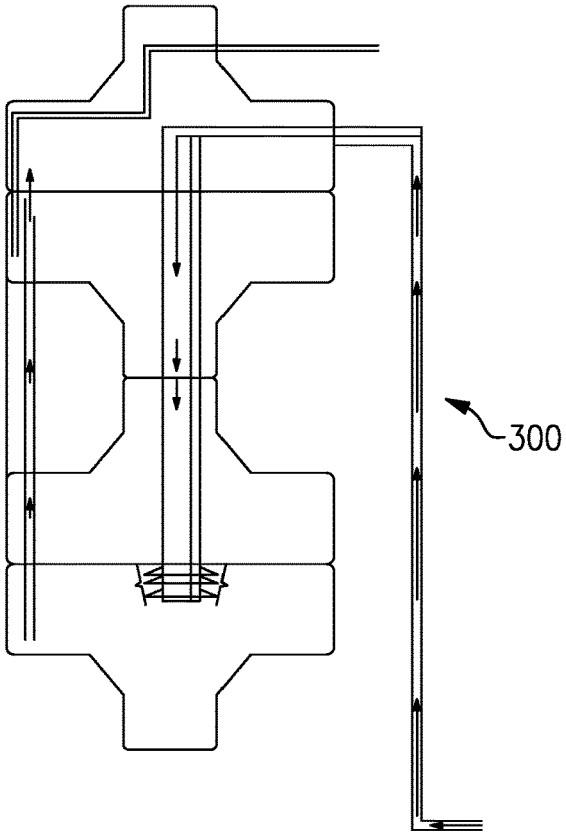

FIGS. 22 and 23 show water filtration arrangements 300 for cleaning and reusing the recycled rinse water captured in the lower channel.

The control means for commencing and/or controlling a window cleaning operations, while not shown here, would be within the ability of an electrical or mechanical engineer that has worked in this general field. An articulated robotic arm may be employed rather than one that follows tracks at the top and bottom frame rails.

There are many other embodiments of the window cleaning system of this invention, as described above, within the scope of this invention, as defined in the appended claims.

I claim:

1. In combination, a window adapted to be emplaced in a wall of a building at an elevation above the ground, the window having a window glass and a frame holding the glass in place, the frame having frame members at left and right sides, top and bottom of the frame, with one of said left and right side frame members having a door therein, and the top and bottom frame members having a channel member extending therealong, wherein the bottom frame channel member is also a return water channel member;

a robot arm positioned within a compartment behind the door in said side frame member and extending between upper and lower guide members thereof, and including a mechanism for selectively pushing said robot arm out from said compartment and urging the robot arm to travel laterally from said side frame member across the window glass and back, and guided by said upper and lower guide members that travel respectively in said channel members;

a spray jet directed toward said window glass and configured for spraying a jet of water onto said window glass as said robot arm travels laterally across said window glass;

a reservoir in said compartment containing water for cleaning, a first supply conduit feeding water from said reservoir to said spray jet on said robot arm, a return conduit connected from said channel member in said bottom frame member to said reservoir, and a filter for cleaning and recycling the return water from said return conduit;

a wiper blade mounted on said robot arm configured to travel across said window glass; and said reservoir comprising a first water canister and a second water canister; said first water canister being adapted to contain a supply of clean water, and said second water canister configured to receive water from said return water channel member; the second water canister including a second supply conduit supplying water to said first water canister and said filter removing dirt particles from the return water supplied from the second water canister to the first water canister.

2. The combination of claim 1 wherein said window is mounted into a building wall at a high story of said building.

3. The combination of claim 1 wherein said blade has two-part construction with a sponge component and a hard rubber blade component positioned adjacent said sponge component.

4. The combination of claim 1 wherein said robot arm is configured to move in a horizontal direction when deployed for cleaning the associated window glass.

5. The combination of claim 3 wherein said sponge component and said rubber blade component are configured to travel together against an outer surface of said window glass when said robot arm travels laterally in one direction across the window glass and in an opposite return direction across said window glass.

6. The combination of claim 5 wherein said rubber blade component squeezes against said window glass as said robot arm travels in said return direction, such that the return water flows down into said return water channel member.

7. The combination of claim 1 wherein said filter is in said second canister.

8. The combination of claim 7 wherein said filter is configured to remove said dirt particles by centrifugal action.

9. The combination of claim 1 wherein said first and second water canisters are positioned in said frame as an upper canister and a lower canister, respectively.

10. The combination of claim 1 wherein said first water canister is coupled to a supply of make-up water to receive fresh make-up water as needed.

11. The combination of claim 1 wherein the wiper blade is formed partly of foam rubber and partly of hard rubber positioned side-by-side.

12. The combination of claim 1, wherein the wiper blade is formed of an outer blade and an inner blade configured parallel to one another so as to close any gaps between said wiper blade and the window glass.

* * * * *